United States Patent [19]

Jennie

[11] 4,125,054

[45] Nov. 14, 1978

[54] MECHANISM FOR GAS CONTROL IN AN AUTOMATIC FIREARM

[75] Inventor: Fred L. Jennie, Anaheim, Calif.

[73] Assignee: Weatherby, Inc., South Gate, Calif.

[21] Appl. No.: 770,470

[22] Filed: Feb. 22, 1977

Related U.S. Application Data

[63] Continuation-in-part of Ser. No. 726,939, Jul. 30, 1976.

[51] Int. Cl.[2] ..... F41D 5/08

[52] U.S. Cl. ..... 89/193; 89/191 A

[58] Field of Search ..... 89/191 A, 193

[56] References Cited

U.S. PATENT DOCUMENTS

| | | | |
|---|---|---|---|
| 1,382,058 | 6/1921 | Bourdelles | 89/193 |
| 2,393,627 | 1/1946 | Garand | 89/193 |
| 4,014,247 | 3/1977 | Tollinger | 89/191 A |

*Primary Examiner*—Stephen C. Bentley

*Attorney, Agent, or Firm*—Albert M. Herzig; Edward C. Walsh

[57] ABSTRACT

An improvement in gas operated firearms having means for regulating the flow of gas from the barrel of the firearm to the piston which operates the action of the firearm. The improvement is a device which eliminates the necessity of having to change the barrels to accommodate different types of ammunition and loads. The improvement embodies a combined gas regulator and piston receiver associated with the reciprocating piston that actuates the action of the firearm. The combined gas regulator and piston receiver is reversible and in either of its positions fits in sealing relationship against the member which depends from the barrel of the gun and contains the gas orifices that deliver the gas from the barrel, to the regulator. The regulator-receiver has a bore that fits on the forearm shaft. Equally angularly spaced axial passageways are provided of partial circular configuration at the internal diameter of the regulator. An axial bore or passageway is also provided through the regulator. In one position of the regulator the angularly spaced passageways are closed by a shoulder on the forearm shaft. At one end of the regulator bypass holes or cutouts which are counter-bores are provided at the positions of the axial passageways to provide bypass passageways around the shoulder on the shaft. In this way the regulator can accommodate to different ammunition.

7 Claims, 7 Drawing Figures

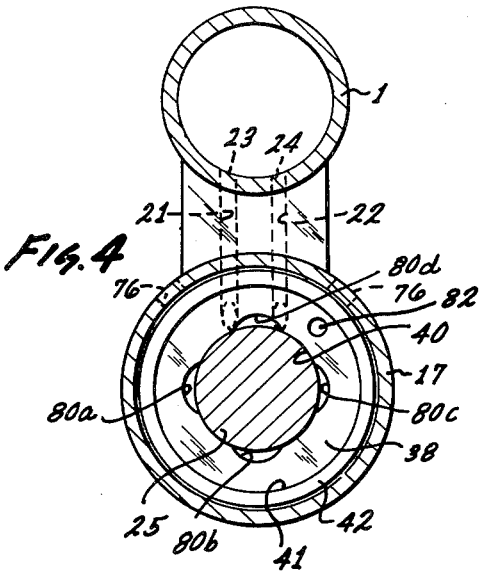
Fig. 4
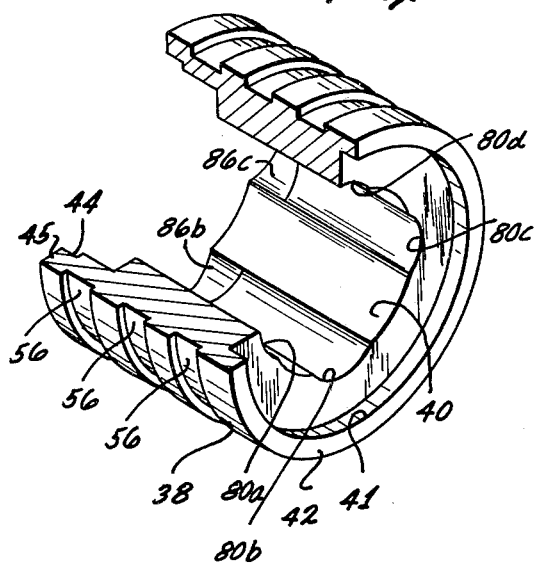
Fig. 5
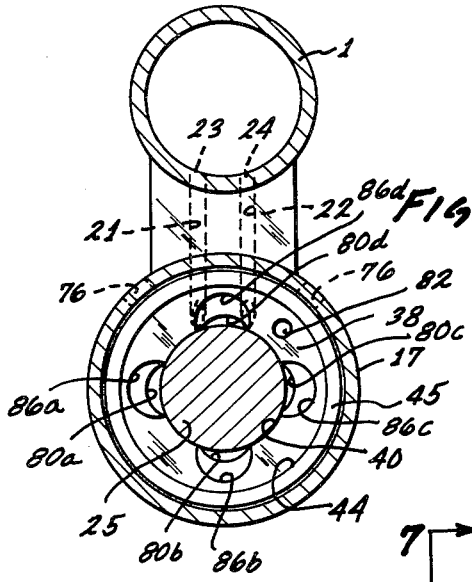
Fig. 7
Fig. 6
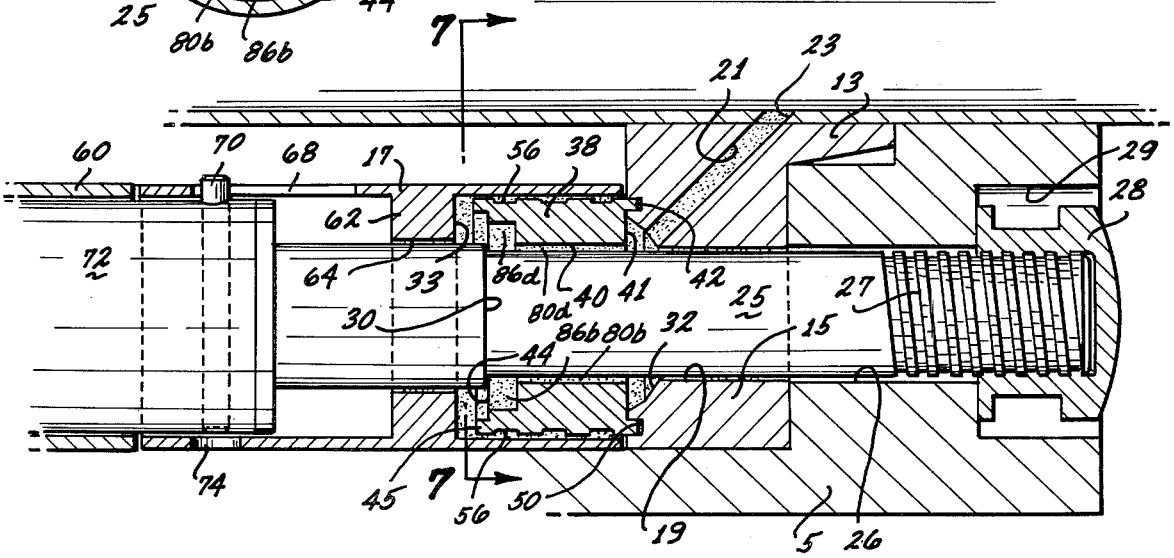

MECHANISM FOR GAS CONTROL IN AN AUTOMATIC FIREARM

This application is a continuation-in-part of Ser. No. 726,939 filed July 30, 1976.

BACKGROUND OF THE INVENTION

1. Field of the Invention

The field of the invention relates to gas operated firearms. Gases flow from the firearm barrel into an operating piston which actuates an automatic mechanism for extraction, ejection, feeding and chambering of the ammunition. The improvement is in the means for regulating the flow of gases from the barrel to the operating piston.

2. Description of the Prior Art

Attempts have been made in the prior art to control the volume of the gases that flow into operating pistons which actuate automatic mechanisms for extracting, ejecting, feeding and chambering ammunition in firearms such as gas operated shotguns. These attempts involve the venting of surplus gases to the atmosphere and have met with success when firing shotgun shells having relatively low pressure. However, when heavier loads such as magnum shot shells are utilized, severe hardship on firearm mechanisms occurs and to alleviate this situation special model firearms are manufactured for the heavy magnum loads or special barrels are used which restrict the flow of gases by means of smaller gas orifices to the barrel. It is not practical to attempt to control the size and area of orifices in the barrel conveying gases to the actuating piston. The result is that it has been necessary to provide different interchangeable barrels having sizes or quantities of gas orifices. Typically in the prior art the gun is provided with a receiver with which the actuating cylinder has sliding engagement. The prior art lacks the improvements of the herein invention as to the metering or regulating of flow of gas to the operating piston.

SUMMARY OF THE INVENTION

The invention described herein is embodied in a gas operated firearm having a gas operated piston for operating the action of the firearm, there being channels for conveying gas from the barrel of the firearm to a piston which actuates an automatic mechanism for extraction, ejection, feeding and chambering of ammunition. The invention provides a metering device associated with the gas operated cylinder which operates the action of the firearm. The metering device is positioned to restrict the flow of gases to the actuating cylinder. The metering device is constructed as a combined regulator-receiver, being formed as a reversible receiver cylinder, the operating piston having a sleeve telescoped on the outside of the regulator-receiver.

Of paramount importance in the design of a gas operated automatic or semi-automatic firearm is the time-pressure relationship or characteristic of the ammunition. In a gas operated shotgun which must accommodate a variety of shot shell loads, the time-pressure relationship changes according to the load. The time-pressure curve or characteristic time can be correlated to the position of a projectile at any point along the barrel or bore and can determine the pressure at that point. It is also known that as time is increased pressures must necessarily be reduced. For example, a delay of 100 micro-seconds could conceivably at some point on the downward slope of the pressure curve reduce pressures by 1,000 psi.

Accordingly, any delay that can be created such as the time necessary to fill a gas chamber in a gas piston type of the firearm must necessarily also reduce operating pressures within that gas chamber. Such delay, while not necessary on lower pressure ammunition is required on ammunition giving rise to higher pressures.

Pressures generated by shot shell ammunition vary considerably in magnitude when switching from light target loads to the heavier magnum type game loads. It is common practice when switching from light target loads to the heavier magnum type game loads in an automatic or semi-automatic firearm necessarily change to a barrel having a reduced quantity of and smaller size gas orifices in order to delay and restrict the volume of high pressure gases entering the receiprocating piston.

The invention as described herein avoids the necessity of having to change barrels for different type ammunition and pressures.

The improvement of the invention serves as a gas regulator as well as a piston receiver working with a closely fitted reciprocating cylinder. The gas regulator-piston receiver is movable and reversible in such a way that gases under pressure leading from a barrel through the gas regulator-piston receiver will be controlled in order to prevent undue hardship on an automatic or semi-automatic firearm. The regulator-piston receiver is adapted in one setting for a low to medium gas pressures and when reversed is adapted for medium to high pressures. As stated, the single combined device serves as a gas regulator as well as a piston receiver with the gas cylinder reciprocating on the outside of the receiver.

In the light of the foregoing, the primary object of the invention is to provide an improvement in gas operated firearms consisting of a gas regulator constructed to regulate gas pressures in such a way as to eliminate the necessity of having to change barrels for different types of ammunition and pressures.

A further object is to provide an improvement as in the foregoing wherein the regulator takes the form of a cylindrical member with which the gas cylinder has sliding engagement, the member being removable and reversible and having sealing engagement with the depending part of the barrel containing the gas orifices in either position of the regulator.

A further object is an improvement as in the foregoing wherein the regulator is constructed to achieve the regulating effect by way of spaced axial passageways provided along its inner diameter wherein the passageways having relationship to a shaft on which the regulator fits as to either close or leave open the axial passageways.

Further objects and additional advantages will become apparent from the following detailed description and annexed drawings.

BRIEF DESCRIPTION OF THE DRAWING

FIG. 4 is a sectional view taken along the line 4—4 of FIG. 3;

FIG. 5 is an isometric view partly in section of the receiver-regulator cylinder.

FIG. 6 is a sectional view similar to that of FIG. 3 with the receiver-regulator in its reverse position;

FIG. 7 is a sectional view taken along the line 7—7 of FIG. 6.

DESCRIPTION OF THE PREFERRED EMBODIMENT

Figure 1:
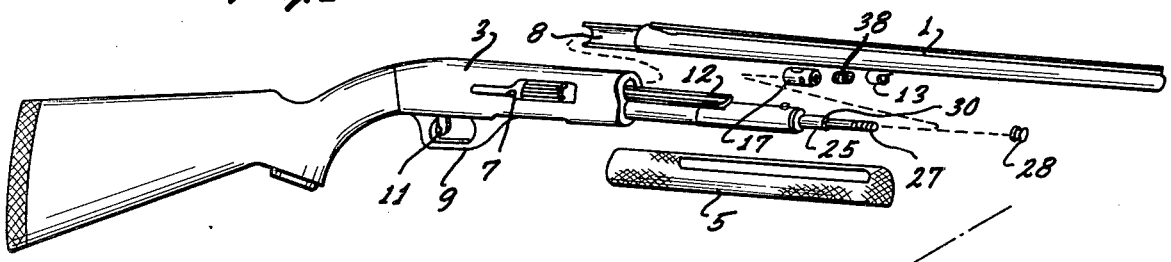
FIG. 1 is a pictorial exploded view of the firearm illustrating the improved parts.

Referring to FIG. 1 in the drawings, a typical shotgun is shown with the barrel 1 removed from the receiver 3 and with the slide grip cover 5 removed. The typical receiver 3 has a side opening 7, which is a typical ejection port through which spent shells or cartridge cases are ejected, and a trigger guard 9 and trigger 11. Parts 8 and 12 of the barrel and receiver respectively fit together when the parts are assembled.

The construction of the receiver and barrel is typical of firearms of the type referred to with modifications as described herein added, to provide for regulation of the flow of gases from spent cartridges.

Figure 2:
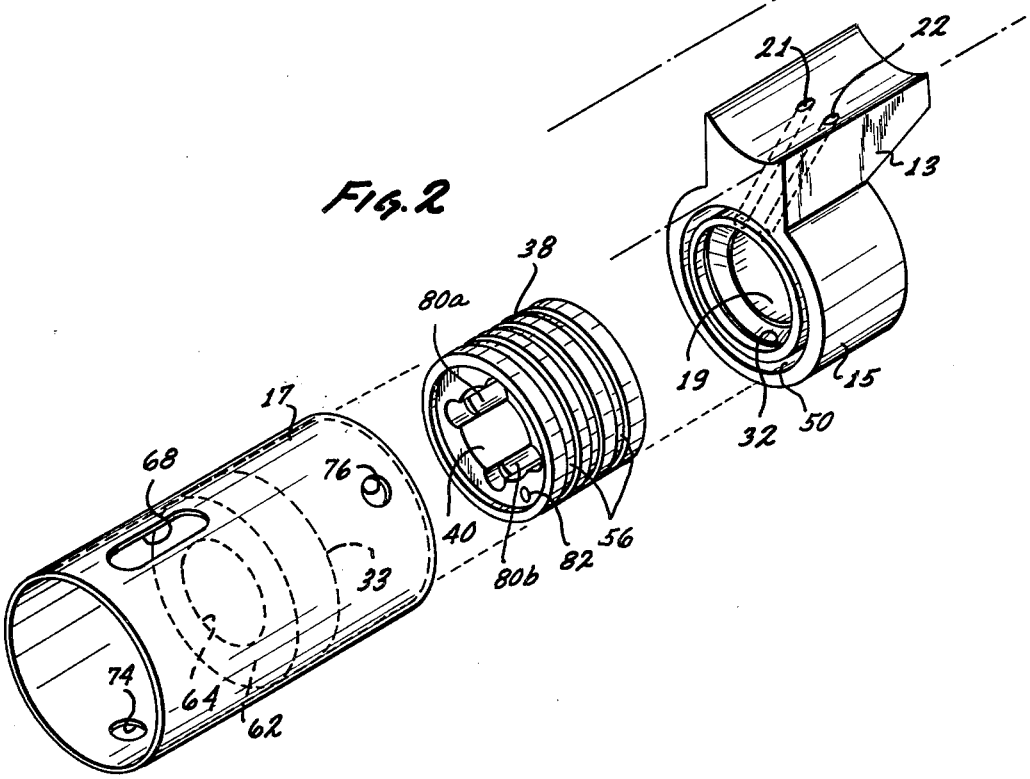
FIG. 2 is an isometric exploded view illustrating the gas cylinder in the receiver.
Figure 3:
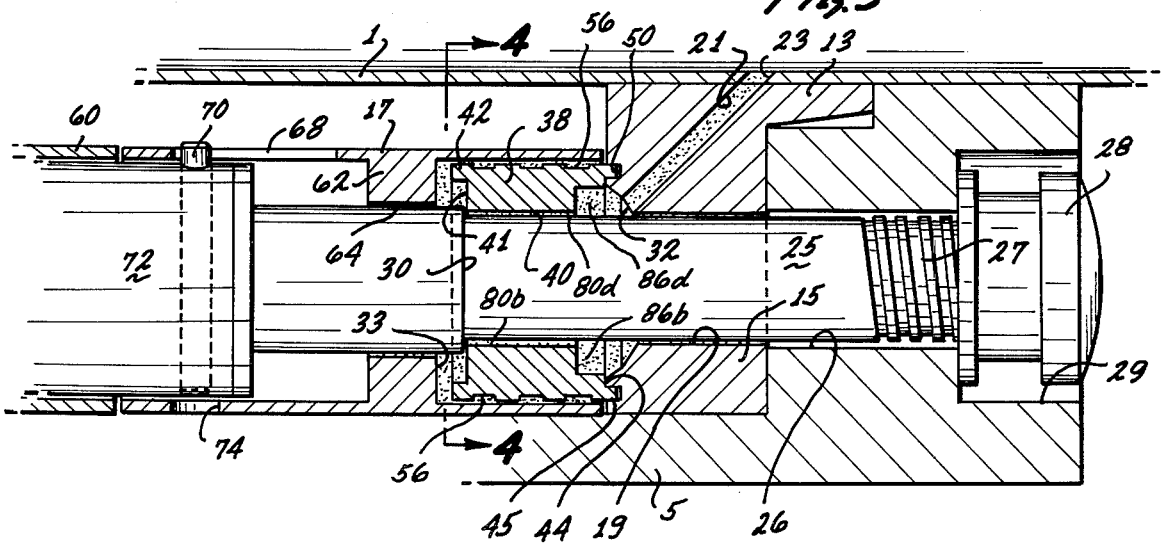
FIG. 3 is a sectional view taken through the receiver and gas cylinder with the gas regulator in one position.

Referring to FIG. 3, which is a cross-sectional view of the receiver assembly, part 13 is shown having a cylindrical protuberance 15 with which piston 17 is associated. As can more readily be seen in FIG. 3, housing 13 contains an internal bore 19 which communicates with gas channels 21 and 22. The firearm barrel 1 has orifices 23 and 24 with which gas channels 21 and 22 are aligned. Referring to FIG. 2, it can be seen that gas channels 22 and 24 align with orifices 23 and 24 of the firearm barrel. Protuberance 15 may be referred to as a "receiver" or part of the receiver. Shaft 25 extends through bore 19. It extends through bore 26 in slide grip 5 as shown. It has threads 27 at its end which receive lock nut 28 in counterbore 29. On shaft 25 is an annular shoulder 30.

Cylindrical protuberance 15 has a double tapered counterbore 32 which terminates into internal bore 19, thereby forming a chamber within member 15 through which gases from firearm barrel 1 communicate through gas channels 21 and 22. Piston 17, which is slideably mounted around the regulator-receiver as will be described is responsive to gas pressures within bore 19. Gases acting upon internal face 33 of piston 17 cause said piston to move horizontally in relationship to fixed longitudinal shaft 25 and cylindrical protuberance 15.

Numeral 38 designates the gas regulator-piston receiver. The gas regulator-piston receiver 38 fits firmly between the shoulder 30 on the shaft 25 and the protuberance 15 which is carried by the barrel 1. The member 38 is reversible end for end as will be described. It is shown more in detail in FIGS. 2 and 5. It has a bore 40 which is received on the shaft 25 as may be seen in FIGS. 3, 4 and 6. At the left end it has a counter bore 41 providing a peripheral flange 42. See FIG. 5. The opposite end has a similar counter bore 44 providing an end flange 45. See FIG. 2. The protuberance or extending member 15 has a machined groove 50 which can receive the flange 42 or flange 45 at either end of the member 38, as illustrated in FIGS. 3 and 6. FIG. 6 shows the element 38 in reverse position with respect to the position in FIG. 3. Annular machined groove 50 in member 15 may be provided with a sealing ring against which the flange on member 38 seals. As may be seen in member 38, it is firmly held between the annular shoulder 30 and the member 15 when being held by the shaft and the forearm nut 28 on the end of it.

Annular grooves 56 are provided along the outside surface of the member 38 to provide a scraping action to remove carbonaceous deposits which will naturally accumulate on the inner diameter of piston 17 and the outer diameter of the shaft 25, which also may have grooves as described. Such deposits as referred to will fall into the annular grooves and prevent interference of movement.

In order for the firearm to function on lower pressures, the orifices in part 15 must be of sufficient diameter to permit the necessary volume of pressurized gas to flow into the gas regulator-piston receiver 38 which in turn allows the volume necessary to enter the gas piston 17, thus forcing said piston to the left against tube 60 which is coupled to the breech mechanism not shown. The cylinder 17 has an internal web 62 as shown, having a bore 64 in it which fits on the part of shaft 25 of the larger diameter. The portion of cylinder 17 to the right of web 62 fits around the outside of the gas regulator-piston receiver 38. The part of cylinder 17 to the left of web 62 has an axial slot 68 in it as may be seen in FIG. 3 which engages radial pin 70 in the shaft part 72. In the side wall of the cylinder 17 opposite the end of the pin 70 is an opening 74. Pin 70 secures shaft 25 to tube 72. The cylinder 17 is provided with two vent holes, one of which may be seen at 76 in FIG. 2, which serve to vent the interior of the cylinder and the member 38 when the cylinder reaches the limiting position to the left.

The flow of gases through the gas regulator-piston receiver 38 is accomplished in certain preferred ways dependent on the geometric shape of ducts provided through the regulator. As may be seen in FIG. 4, four axial ducts are provided through the member 38 which are in the form of partially circular segments on the internal diameter of bore 40, these ducts being designated at 80*a*, 80*b*, 80*c*, and 80*d*. There is also a single hole or axial bore through the member 38 as designated at 82. The combined area of the ducts 80 and 82 is sufficient to allow passage of a sufficient volume of gas to actuate the piston 17 and the breech bolt mechanism.

It is to be noted that the passageways or ducts 80*a*–80*d* are completely closed at the left end by the shoulder 30 on shaft 25 as may be seen in FIG. 3. Thus, the flow of gas to these ducts would be prevented allowing flow only through the axial passageway 82.

In addition to the passageways 80*a*–80*d*, at the opposite end of the member 38 are four bypass holes or cutouts in the form of counter-bores also on the internal diameter 40 of the part 38, and of partial circular shape, as designated at 86*a*, 86*b*, 86*c*, and 86*d*. See FIG. 7. As may be seen in FIG. 3 these bypass holes are at the right end of member 38. In FIG. 6 member 38 is reversed and these holes or cutouts are at its left end so that they bypass the annular shoulder 30.

Shot shells of the magnum variety result in pressures of higher magnitude, some of them as much as 50% greater. Reversing the gas regulator-piston receiver 38 to the position shown in FIG. 3 results in complete restriction of gases flowing through the multiple ducts or passageways 80*a*–80*d* by shoulder 30 on shaft 25. Hole 82 however is not restricted and being sufficiently small in diameter and area, the volume of gases entering the piston 17 are thereby delayed to allow the higher pressure to be reduced, thus causing the piston 17 and breech bolt mechanism to move to the left or rearwardly in the firearm in a manner similar to the lower pressure ammunition.

It is necessary to vent excess gases under pressure to the atmosphere ideally at a time when the gas pressure within the piston 17 has caused it to accelerate rearwardly with sufficient force to actuate the breech bolt mechanism. FIG. 2 illustrates one of the vent holes 76 which are in a position most convenient for venting cylinder 17 when in its limiting position.

From the foregoing those skilled in the art will readily understand the nature and construction of the invention and the manner in which it achieves and realizes of the objects as set forth in the foregoing.

The foregoing disclosure is representative of a preferred form of the invention and is to be interpreted in an illustrative rather than a limiting sense, the invention to be accorded full scope of the claims appended hereto.

What is claimed is:

1. In a gas operated firearm having a gas operated cylinder for operating the action of the firearm, a receiver cylinder within which the gas operated cylinder has sliding engagement, there being channel means for conveying gas from the barrel of the firearm to the receiver cylinder, the improvement comprising the receiver cylinder being constructed to provide means for regulating a flow of gas through the channel means to the gas operated cylinder, the receiver cylinder having axial passageway means positioned to restrict the flow of gases to the gas operated cylinder, the receiver cylinder having a bore having sliding engagement with a shaft, there being axial passageway means positioned between said shaft and the inside of said bore of the receiver cylinder.

2. A firearm as in claim 1, wherein the gas operated cylinder has vent means positioned to be uncovered by movement of the gas operated cylinder.

3. In a gas operated firearm having a gas operated cylinder for operating the action of the firearm, a receiver cylinder with which the gas operated cylinder has sliding engagement, there being channel means for conveying gas from the barrel of the firearm to the receiver cylinder, the improvement comprising the receiver cylinder being constructed to provide means for regulating a flow of gas through the channel means to the gas operated cylinder, the receiver cylinder having axial passageway means positioned to restrict the flow of gases to the gas operated cylinder, the receiver being a cylinder normally secured in sealing engagement to the channel means and being removable therefrom, said receiver cylinder being constructed to be reversible to have either end secured to said channel means.

4. A firearm as in claim 3, wherein said receiver cylinder is constructed whereby at least some of said passageways are obstructed when it is in one of its reversed positions.

5. In a gas operated firearm having a gas operated cylinder for operating the action of the firearm, a receiver cylinder with which the gas operated cylinder has sliding engagement, there being channel means for conveying gas from the barrel of the firearm to the receiver cylinder, the improvement comprising the receiver cylinder being constructed to provide means for regulating a flow of gas through the channel means to the gas operated cylinder, the receiver cylinder having axial passageway means positioned to restrict the flow of gases to the gas operated cylinder, the receiver being a cylinder having a bore having sliding engagement with a shaft and normally secured in sealing engagement to the channel means and being removable therefrom, said receiver cylinder having equiangularly spaced axial passageways formed in the walls of its bore, said shaft having an annular shoulder against which said receiver cylinder seats with the said shoulder obstructing said passageways.

6. A firearm as in claim 5, wherein said receiver cylinder is within said gas operated cylindrical means.

7. A firearm as in claim 5, including an additional axial passageway through said receiver cylinder.

* * * * *